United States Patent [19]

Quigley

[11] Patent Number: 5,016,885

[45] Date of Patent: May 21, 1991

[54] GOLF TRAINER

[76] Inventor: Gary F. Quigley, 2283 S. Thrush Ct., SE., Grand Rapids, Mich. 49546

[21] Appl. No.: 521,599

[22] Filed: May 10, 1990

[51] Int. Cl.[5] ..... A63B 69/36

[52] U.S. Cl. ..... 273/188 R; 434/252

[58] Field of Search ..... 273/188 R, 188 A; 434/252

[56] References Cited

U.S. PATENT DOCUMENTS 4,088,326 5/1978 Bifulco ..... 273/188 R 4,706,957 11/1987 Jackson ..... 273/188 R

*Primary Examiner*—William H. Grieb

*Attorney, Agent, or Firm*—Price, Heneveld, Cooper, DeWitt & Litton

[57] ABSTRACT

A golf training device comprising a pair of substantially identical straps that have one smooth surface and one surface substantially covered with one half of a hook and loop combination but for a short portion near one end of each strap with the short portion near one end being covered with the other half of the hook and loop combination. The end of the strap remote from the short section with one half of the hook and loop material has an attached ring through which the strap can be passed to form a loop. The loop in each strap can be fastened about the calf of the golfer's leg. The straps are placed on a golfer's legs and affixed to each other so that movement of the golfer's legs is restricted. If the golfer swings too hard or too fast, the golfer will sense instability and a loss of balance in his/her legs. The golfer works to develop the smooth swing desired by avoiding those movements that cause the sensation of instability. The training device can be used in practice and the actual playing of the game by repositioning the straps until needed.

13 Claims, 1 Drawing Sheet

GOLF TRAINER

BACKGROUND OF THE INVENTION

Golf is one of the most popular sports in the world today. Golf is a relatively simple game to play because the equipment required consists only of a set of golf clubs, a few golf balls and a golf course. Golf, however, is a game that requires a definite amount of repetitive practice in order to play competently. Practice is required in order to ensure that each part of a golfer's body—the legs, arms, wrists, hands, head, etc.—does what it is supposed to do as the golfer swings a golf club in order to propel the golf ball to the desired location.

There are devices available designed to help a golfer practice swinging a golf club in the correct manner. One of these devices is a helmet that a golfer wears while practicing. This helmet has a weighted bell on the front of it so that if the golfer's head is lifted out of the correct position the bell will ring. Most of the available training devices for golf are cumbersome, uncomfortable to wear and some of them, such as a frame that a golfer stands in to practice his/her swing, are large, expensive and fixed-in-place.

SUMMARY OF THE INVENTION

The golf training device of the present invention is designed to help a golfer practice and develop his/her golf swing in such a manner that the golfer swings the golf club in a slow, steady arc rather than in a quick, jerky type of motion. The device accomplishes this by restraining the movement of the golfer's legs so that if the golfer swings the golf club too quickly and/or too jerkily, the golfer will sense instability or a loss of balance in his/her legs. The golfer then continues practicing until the swing does not produce the sensation of instability. This golf device is lightweight and readily portable so that a golfer can wear it while practicing and can also wear it during the playing of an actual game for help in remembering to swing the golf club slowly and smoothly.

The golf trainer device of the present invention consists of two straps of material with a ring at one end of each strap. The end of the strap opposite the ring is slid through the ring, forming a loop at one end of the strap and a free end at the other. To use the golf trainer device, the golfer merely places one of the loops on each leg and then affixes the free end of the strap on one leg to the loop of the other strap such that the legs of the golfer are held in place, a desired distance apart. The free end of the strap can be affixed to the exterior of the loop portion of the other strap by means of a hook and loop type fastener such as is sold under the trade name of Velcro ®. The distance the legs are held apart can be varied depending upon the desired stance of the golfer; for example, a golfer making a long drive would want his/her legs farther apart than a golfer making a short chip shot.

The golf training device can be worn during practice and while playing a game of golf. In practice as described above, the golfer's legs are held together; during the actual playing of a game of golf the device can be disattached so that the golfer's legs can freely move so the golfer can walk between the spots where he sets up to hit the golf ball. To switch the device from the play position to the practice position takes just seconds; all the golfer has to do is reattach the straps so that his/her legs are held together. When the straps are not attached together, the free end of each strap can be loosely attached about the loop on the same leg of the golfer.

The purpose of the training device is to hold a golfer's legs the desired distance apart while the golfer makes a swing. The device will enable the golfer to sense instability or a tendency to lose one's balance if the swing is not smooth. The device enables a golfer to develop a consistent smooth swing.

DESCRIPTION OF THE PREFERRED EMBODIMENT

Figure 2:
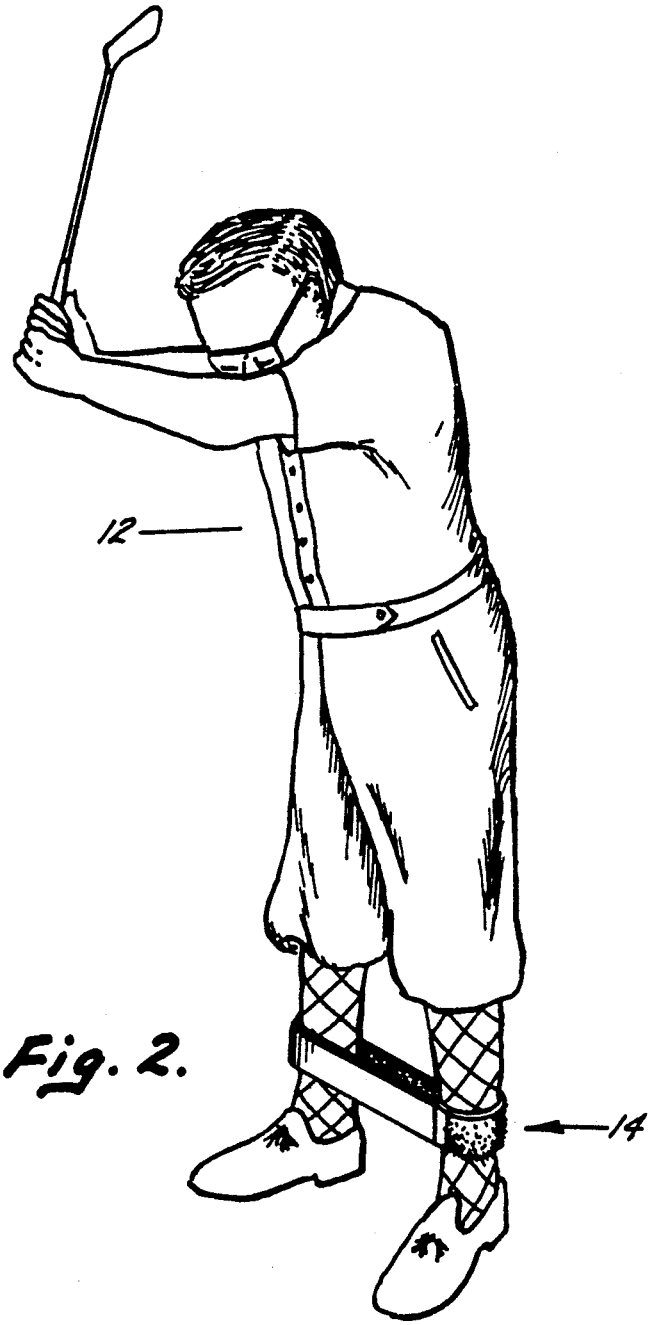
FIG. 2 is a perspective view of a golfer using the golf trainer to hold his/her legs a certain distance apart while the golfer makes a golf swing.
Figure 1:
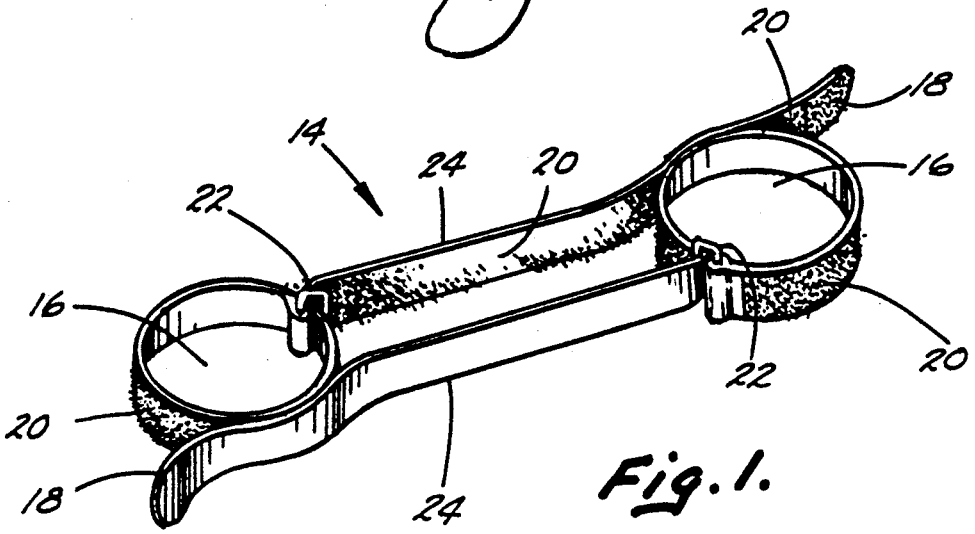
FIG. 1 is a perspective view of the golf trainer showing the loops that the golfer puts his/her legs through and the ends of the straps, holding the loops, and thus the golfer's legs, a certain distance apart from each other.

The golf trainer 14 is shown in FIGS. 1 and 2. Golf trainer 14 consists of substantially identical straps of material 24. The straps can be anywhere from one foot to three feet in length with two feet being the preferred length. The straps can be anywhere from one-half inch to five inches wide with two inches being the preferred width. The straps can be made out of any durable polymeric fabric with polypropylene being the preferred material. The fabric is preferably water resistant—to enhance the wearability of the device. The straps can be of any selected color and can have indicia on the exposed surfaces. The preferred color is bright yellow which makes it very easy to locate the golf trainer device when it is not being used.

Each of the straps 24 has a ring 22 at one end. Ring 22 can be affixed to strap 24 by sewing or by using adhesives or heat sealing techniques The opposite end 18 of each strap 24 is slid through ring 22 in order to form loop 16. Each strap has one smooth side while the opposite side has substantially all but for an end portion covered with one half of a hook and loop pair. The last two to three inches of the strap, on the same side, is coated with the other half of the hook and loop combination. The last two to three inches of the strap, known as opposite end 18, is then affixed, by means of this hook and loop type fastener, to the exterior 20 of loop 16. As is mentioned above, hook surface 18 and loop surface 20 can be interchanged on straps 24.

The hook and loop fastening type system shown in FIG. 1 is the preferred form of this invention in view of the infinite adjustability. Other fastening systems can be used, such as a button/buttonhole-type fastener, a shoelace type fastener or even a one-sided tape type fastener, with a loss of convenience of operation. The type of hook and loop fastener known as Velcro ® is most preferred.

FIG. 2 shows a golfer 12 wearing the golf trainer device 14 while practicing his golf swing. The distance the golfer's legs are held apart can be varied depending on how far along the loop 16, of each strap 24, the free end of the opposite strap is affixed. The size of the loop 16 can also be adjusted to accommodate golfers with different sizes of legs.

The fact that the golfer's legs are restrained while he/she swings the golf club means that if the golfer swings the club too quickly or does not swing the club smoothly the golfer will be able to sense instability or a loss of balance in his/her legs With repetitive practice the golfer will be able to slow down and smooth out his/her swing such that he/she does not sense instability in his/her legs.

When golfer 12 is finished with his golf shot he/she can disattach strap 24 from exterior 20 of loop 16 and reattach the end 18 to the exterior of loop 16 that it is linked with, in order to free his/her legs so that he/she can freely walk. Upon reaching the position required for the next shot the golfer can reattach the golf training device in the manner illustrated in FIG. 2 and take another shot.

Though the invention has been described with respect to a specific preferred embodiment thereof, many variations and modifications will become apparent to those skilled in the art. It is, therefore, the intention that the appended claims be interpreted as broadly as possible in view of the prior art to include all such variations and modifications.

The embodiments of the invention in which an exclusive property or privilege is claimed are defined as follows:

1. A device for improving the swing of a golfer by restricting the movement of said golfer's legs, causing a sensation of a loss of balance when said golfer is swinging incorrectly, comprising:

a strap means for fastening about each leg of a golfer;

means having an aperture therein at one end of each of said straps;

each of said straps being capable of having an end portion thereof slidably passed through said aperture such that a loop can be formed in said strap for placement about a portion of a golfer's leg; and means on said strap means for fastening said strap means together to restrict the movement of said golfer's legs.

2. The device of claim 1 in which said means on said strap means for fastening said strap means together comprises:

each of said straps having a major portion of a surface covered by one-half of a hook and loop type fastening system with the remaining end portion of said strap being covered by the second half of a hook and loop type fastening system.

3. A device for improving the swing of a golfer by restricting the movement of said golfer's legs, causing a sensation of a loss of balance when said golfer is swinging incorrectly, comprising:

a pair of elongated straps;

means with an aperture therein at one end each of said straps;

each of said straps having a first and second surface, said first surface being substantially smooth, said second surface being substantially covered by one half of a hook and loop type fastening system with the remaining end portion of said second surface of said strap being covered by the second half of a hook and loop type fastening system;

each of said straps being capable of having said end portion slidably passed through said aperture such that a loop can be formed in said strap for placement about a portion of the leg of a golfer with the outer surface of said loop being covered with one half of a hook and loop type fastening system, said end portion of said straps being capable of being detachably secured to said loop to restrict the movement of said golfer's legs.

4. The device of claim 3 in which said means with an aperture therein comprises a ring.

5. The device of claim 3 in which said straps are between approximately one foot and three feet in length.

6. The device of claim 3 in which said straps are two feet long.

7. The device of claim 4 in which said straps are between approximately one-half inch and five inches wide.

8. The device of claim 4 in which said straps are two inches wide.

9. The device of claim 4 in which said straps are made out of polymeric fabric.

10. The device of claim 4 in which said straps are made out of polypropylene fabric.

11. The device of claim 4 in which said straps are yellow in color.

12. The device of claim 4 in which said straps are waterproof.

13. A method for improving the swing of a golfer comprising the following steps:

providing a pair of elongated straps having a ring at one end of each strap and a plurality of fastening means extending along one surface of said straps;

forming a loop in each strap by passing the end of each strap through its associated ring;

positioning said loop in each strap about each leg of said golfer;

connecting the legs of said golfer together by attaching the free end of each strap to said strap on the other leg of said golfer;

whereby said golfer will sense a loss of physical balance when a golf swing is not made correctly.

* * * * *